US009631299B2

(12) United States Patent
Maleck et al.

(10) Patent No.: US 9,631,299 B2
(45) Date of Patent: Apr. 25, 2017

(54) TEXTILE MACHINE, ESPECIALLY SPINNING MACHINE OR WINDING MACHINE, WITH A CONTROL AND COMMUNICATION SYSTEM

(71) Applicant: Rieter Ingolstadt GmbH, Ingolstadt (DE)

(72) Inventors: Mario Maleck, Walting (DE); Harald Widner, Ingolstadt (DE)

(73) Assignee: Rieter Ingolstadt GmbH, Ingolstadt (DE)

( * ) Notice: Subject to any disclaimer, the term of this patent is extended or adjusted under 35 U.S.C. 154(b) by 610 days.

(21) Appl. No.: 14/052,019

(22) Filed: Oct. 11, 2013

(65) Prior Publication Data

US 2014/0107829 A1 Apr. 17, 2014

(51) Int. Cl.

| | |
|---|---|
| ***G06G 7/66*** | (2006.01) |
| ***D01H 7/00*** | (2006.01) |
| ***D01H 13/00*** | (2006.01) |
| ***B65H 54/26*** | (2006.01) |
| ***D01H 13/14*** | (2006.01) |

(52) U.S. Cl.

CPC ..... *D01H 7/00* (2013.01); *B65H 54/26* (2013.01); *D01H 13/005* (2013.01); *D01H 13/145* (2013.01)

(58) Field of Classification Search

CPC ..... D01H 7/00; D01H 13/145; D01H 13/005; B65H 54/26

USPC ..... 700/130, 139

See application file for complete search history.

(56) References Cited

U.S. PATENT DOCUMENTS 4,475,331 A * 10/1984 Promoli ..... D01H 4/48 57/263
4,823,544 A * 4/1989 Igel ..... D01H 13/32 57/264
4,840,022 A * 6/1989 Karl ..... B65H 54/26 104/106
4,944,033 A * 7/1990 Erni ..... D01H 13/145 700/130
5,710,708 A 1/1998 Wiegand (Continued)

FOREIGN PATENT DOCUMENTS

DE 42 12 629 A1 10/1993
DE 195 48 667 A1 6/1997

(Continued)

OTHER PUBLICATIONS

German Patent Office Search Report, Jun. 24, 2013.
EP Search Report, Jan. 15, 2014.

*Primary Examiner* — Nathan Durham
(74) *Attorney, Agent, or Firm* — Dority & Manning, P.A.

(57) ABSTRACT

A textile machine, especially a spinning machine or winding machine, has numerous identical workstations arranged beside one another along a longitudinal side, with numerous maintenance devices movable along the workstations for servicing the workstations, and with a control and communication system. The maintenance devices are connected to a bus topology component through a maintenance device bus line, in which case at least some of the bus topology components are connected to the control and communication system with a common bus line. The bus topology components are arranged in a middle area of the textile machine, in the longitudinal direction (LR) of the textile machine.

16 Claims, 7 Drawing Sheets

(56) References Cited

U.S. PATENT DOCUMENTS

| | | | | |
|---|---|---|---|---|
| 5,801,949 | A * | 9/1998 | Raasch | B65H 54/26 57/264 |
| 5,857,637 | A | 1/1999 | Straaten et al. | |
| 6,772,697 | B2 * | 8/2004 | Stephan | D01H 15/013 104/264 |
| 7,010,383 | B2 * | 3/2006 | Zipperer | B65H 54/26 700/139 |
| 7,113,843 | B2 * | 9/2006 | Bahlmann | B65H 54/26 700/130 |
| 7,412,818 | B2 * | 8/2008 | Doerner | B65H 67/068 57/268 |
| 2004/0024484 | A1 * | 2/2004 | Bahlmann | D01H 4/42 700/130 |

FOREIGN PATENT DOCUMENTS

| | | | |
|---|---|---|---|
| DE | 101 42 976 | A1 | 3/2003 |
| DE | 101 53 457 | A1 | 5/2003 |
| DE | 101 59 153 | A1 | 6/2003 |
| DE | 10 2007 043 418 | A1 | 3/2009 |

* cited by examiner

TEXTILE MACHINE, ESPECIALLY SPINNING MACHINE OR WINDING MACHINE, WITH A CONTROL AND COMMUNICATION SYSTEM

FIELD OF THE INVENTION

The invention relates to a textile machine, especially to a spinning machine or winding machine, with numerous identical workstations arranged beside one another along a longitudinal side, with numerous maintenance devices movable along the workstations for servicing them, and with a control and communication system. Every one of the maintenance devices is connected to a bus topology component through a maintenance device bus line, in which case at least some of the bus topology components are connected to a common bus connection of the control and communication system.

BACKGROUND

Such textile machines are known from state of the art. They can be, in particular, spinning machines, for example a rotor spinning machine or a winding machine.

The term "identical workstations" is understood as units capable of executing a defined work process simultaneously. It is obvious that during the operation of the textile machine, individual or several of the identical workstations are in another phase of the working process as the others. For example, some of the workstations can be in a production phase, others in a preparation phase of the production phase, and still others in a resting phase. Typically, the workstations are combined into sections, in which case one section can include 20 workstations, for example.

In spinning machines, this work process is typically a spinning process, i.e. a manufacturing process for a yarn that can include the winding of the yarn produced on a bobbin, for example a cross-wound bobbin; in winding machines, a winding process, i.e. a process for manufacturing a bobbin of pre-produced yarn. Usually, in textile machines, the workstations are arranged in each case beside one another along both longitudinal sides.

Each workstation has the essential components required for executing the work process. However, it is not necessary for the workstations to be absolutely identical. Thus, for example, individual workstations can be equipped with additional sensors for registering certain sizes that must be registered only once for several workstations.

Although textile machines in which the workstations are arranged along only one longitudinal side are conceivable, it is nonetheless usual to arrange the workstations beside each other along both longitudinal sides.

Typically, the workstations are combined in sections arranged between two terminal frames, from which the first terminal frame—also known as a operating frame—can include a central operating device and the other terminal frame—also known as a driving frame—can include central drives for the workstations.

It is furthermore customary for such textile machines to have many maintenance devices for servicing the workstations that can be moved along the work stations. The maintenance devices can be especially developed on the workstations for cleaning them and/or for repairing malfunctions, such as for repairing broken yarn, for example.

In order to allow the textile machine to operate and the work processes of the textile machine components to be operated, a control and communication system has been provided that typically includes a central control device connected to the central operating installation and that can be especially arranged in the operating frame. Likewise, the control and communication system can include a driving control device that controls the central drives and is usually arranged in the driving frame.

Apart from that, the control and communication can have a sectional control device for every section for controlling the respective section and, for each workstation, a workstation control device for controlling the respective workstation. It is furthermore also customary for each one of the maintenance devices to have a maintenance device control device.

Usually, the control and communication system includes one or several data buses that allow communication (i.e. data transfer) between the central control device, the sectional control devices, the workstation control devices, the maintenance device control devices and/or, if applicable, existing additional control devices.

Here, a data bus is generally understood to be a system for transferring data between several participants via a common transfer path, in which the participants do not participate in the data transfer between the other participants.

Generally, data buses consist of at least one physical bus line and the bus participants connected to it, also known as nodes, which in a generic textile machine can be the control devices mentioned above. Typically, the bus participants are connected to the respective bus line by means of the so-called IDC method of termination or plug systems without physically interrupting the bus line as a result of this.

Simpler data buses include merely an inner bus line to which all bus participants are connected. On each one of the two open ends, it is possible to place a terminal resistance to prevent reflections of the typically high-frequency electric signals.

So several bus lines can be physically coupled, it is customary to use bus topology components such as repeaters or bridges. As a result of this, data buses in tree or star topologies and/or with long stubs become possible. In addition, this method allows data bus systems that have several logically autonomous data buses to become possible.

Usually, data buses are developed in textile machines as a field bus, particularly as a CAN bus (controller area network bus) and often the CAN open bus protocol is used. The nodes, but also the bus topology components in particular, are developed so they support the respective protocol.

It is furthermore customary in generic textile machines that every one of the maintenance devices is connected to such a bus topology component through a physical maintenance device bus line, in which case at least some of the bus topology components are connected to a common bus line of the control and communication systems. As a result of this, a data exchange both among the maintenance devices themselves and with other nodes of the respective data bus is made possible.

The maximum length of the bus lines is inversely proportional to the bandwidth used in a data bus. As a rule, generic textile machines are manufactured with a variable number of sections depending on the order. In this case, there has been a need to increase the maximum number of sections for some time and with it the number of workstations. However, on the one hand, this causes an increase of the amount of data to be transferred by the communication system, which by itself would favor an increase of bandwidth, but on the other hand, the data bus lines also become physically longer owing to the increasingly long textile machines and this would suggest a lowering of the bandwidth. Known control and communication systems therefore limit the maximum number of sections or workstations of a generic textile machine.

SUMMARY OF THE INVENTION

An object of the present invention is to create a textile machine equipped with a control and communication system suitable for a high number of sections or workstations. Additional objects and advantages of the invention will be set forth in part in the following description, or may be obvious from the description, or may be learned through practice of the invention.

An object is solved by arranging at least one part of the bus topology components in a middle area of the textile machine, seen along the longitudinal direction of the textile machine.

In a middle area of the textile machine, seen along its longitudinal direction, is understood to be the area between the two terminal frames of the textile machine, hence the area in which the individual sections are arranged.

The total line length effective for transfer behavior between two maintenance devices of the textile machine results from the sum of the physical lengths of their two maintenance device bus lines, the additional virtual length (which is caused by the transfer behavior of the two bus topology components), and the physical distance of the bus topology components on the respective bus line connecting the bus topology components.

By arranging the bus topology components in precisely the middle area, the two maintenance device bus lines can now be shortened considerably compared to solutions in which the bus topology components are arranged in one of the terminal frames, all other things being equal, so that the total effective line length for the transfer behavior between two maintenance devices can also be significantly shortened.

The following example will illustrate this: In a known textile machine, the maintenance devices are movable along the entire machine. In this context, each maintenance device bus line includes a movable section that leads from the maintenance device to a machine-proof connection device arranged in the middle of the textile machine. This movable section has necessarily a length that corresponds to one-half of the length of the textile machine in order to allow the textile machine process to reach the two terminal frames. In the known textile machine, a machine-proof section—which extends from the connection device to a bus topology component arranged in one of the terminal frames and designed as a repeater—now connects to the movable section in every one of the maintenance device bus lines, in which case the bus topology components are connected to a common bus line with a shorter distance. Here, the machine-proof sections also have a length that corresponds to one-half of the length of the textile machine. If data from one maintenance device should now be transferred to another one, then—ignoring the effect of the bus topology components and the distance of the bus topology components on the common bus line—the entire line length effective for the transfer behavior between two maintenance devices is twice the total length of the textile machine.

If, in accordance with the invention, the bus topology components are now arranged in a middle area of the textile machine, then the machine-proof section of the maintenance device bus lines can be shortened considerably—and to be more precise, all the more closer the bus topology components are arranged on the machine-proof connection device. All in all, the entire line length effective for the transfer behavior between two maintenance devices can be significantly shortened, so that in an unchanging maximum line length determined by the design of the data bus, the total length of the textile machine (i.e. the number of sections or workstations) can be increased.

According to an advantageous further development of the invention, the bus topology components are developed as repeaters or as bridges. Here, the repeaters are generally bus topology components that connect the bus lines of a data bus. The bus lines connected by a repeater are in each case electrically autonomous segments of a data bus, which in each case can be terminated with the corresponding terminal resistances so that no reflections on the bus lines occur. From the point of view of signaling technology, the repeater corresponds to a line with a corresponding lag. Consequently, the real time behavior of the data bus is not influenced by the use of repeaters because, with regard to the transfer behavior, it corresponds to a network that consists only of lines.

If the bus topology components are developed as repeaters in a generic textile machine, then this means that the maintenance device are nodes on a data bus that includes the maintenance device bus lines, the repeaters, and the common bus line. In this way, a data transfer between the maintenance devices and additional control devices of the textile machine become possible almost in real time, something that is advantageous in a piecing process in which the actuators of the respective maintenance device and the respective spinning location must be controlled in a perfectly matched way, for example.

A bridge is generally understood to be a bus topology component that can connect different logically separated data buses for data exchange. It is based on the store (modify) forward principle, in which data is received by a data bus, adapted to the protocol if necessary, and sent to another data bus. Compared to repeaters, a bridge allows enlargement of the control and communication system to a maximum expansion because the data buses connected through it work in each case autarkic. In this way, even more sections can be provided. With the help of conversion rules, also known as gateway tables, received bus telegrams can be retransmitted or filtered out under another identifier. Data bus utilization on the data buses of the textile machine connected by the bridges can be reduced with these mechanisms so that, for example, more sections can be attached to a data bus connecting the sections without causing an overload of the bus because telegrams (which are merely of interest for the maintenance devices) do not even reach the data buses connecting the sections in the first place. Here, another protocol can be used in each one of the separated data buses created in this way. Likewise, different bandwidths can be provided on the separated data buses. Even this responds to the wish of having longer textile machines.

In accordance with an advantageous further development of the invention, the bus topology components are arranged in an area of a machine-proof connection device of the maintenance device bus line correspondingly allocated to it. In this way, the machine-proof maintenance device bus line section can be minimized. As a result of this, the entire line length effective for the transfer behavior between the maintenance devices can be minimized and the total length of the textile machine (i.e. the number of sections or workstations) can be maximized through the unchanging maximum line length determined by the design of the data bus.

In accordance with an advantageous further development of the invention, the bus topology components are arranged on an upper side of the textile machine surface. Usually, the movable section of the maintenance device bus lines runs on an upper side of a textile machine. By arranging the bus topology components also along the upper side of the textile machine, it is possible to shorten even more the entire effective line length between two maintenance devices.

In accordance with an advantageous further development of the invention, the bus topology components are arranged in the area of a vacuum duct for supplying the maintenance devices with a vacuum for absorbing thread ends or treating the threads in another way, for example. To achieve this, the respective maintenance device can be automatically attached to the vacuum duct if it is positioned on a workstation. More typically, machine-proof connection devices of the maintenance devices are arranged on one such vacuum duct, so that the arrangement of the bus topology components in an area of a vacuum duct contributes to the further shortening of the effective line length. Moreover, the common bus line can run along the vacuum duct, especially inside the vacuum duct, from which it can be laid easily and protectively.

In accordance with an advantageous further development of the invention, the maintenance device bus lines are executed as trailing cables. Generally, a trailing cable is a flexible cable protected by a likewise flexible guiding device (also known as a trailing chain) that extends from a machine-proof connection device to a movable part of a machine. Trailing cables have a long service life because the bending radius can be maintained by the trailing chain via a permissible minimum radius. In addition, they need no active drive of their own because they can be arranged so they can be dragged by the drive of the movable maintenance device. Here, it is especially advantageous if the maintenance device bus lines are laid with additional lines such as energy supply lines, for example, in a guiding device. In principle, the maintenance device bus lines can also be designed as self-spooling lines, however.

In accordance with an advantageous further development of the invention, the bus topology components are developed as reactionless. This means that the affected bus line connected to the bus topology component has no effect on the other connected bus line. This especially means that a short circuit or defective permanent signal in one of the bus lines will produce no reactions on the other connected bus line. This creates the advantage that a disturbance in one of the bus lines will not lead to the breakdown of the entire system. If there is a short circuit in one of the maintenance device bus lines, for example, then this will not affect the entire bus line and the other maintenance devices can keep communicating through the common bus line.

In accordance with an advantageous further development of the invention, the bus topology components are connected to a machine bus line that extends along the textile machine from a first terminal frame to a second terminal frame. Such machine bus lines are common in modern textile machines and form a so-called machine bus together with the connected node and, if applicable, with further connected bus lines and their nodes. They typically link the central control device, the drive control device and the sectional control devices of the textile machine. Such a machine bus line and the nodes connected to it is called a machine bus. The machine bus line can be especially a linear, continuous physical line laid in a machine-long cable duct, for example. In particular, the machine bus line can consist of section-long parts linked together with the help of connecting screws, plug connectors or the like during the assembly of the textile machine.

If the bus topology components are now at least indirectly linked to the machine bus line, then a direct—and therefore fast—communication between the maintenance devices, on the one hand, and the central control device, the drive control device and the sectional control devices, on the other hand, is possible, and this is especially advantageous when rectifying faults in one of the workstations.

In accordance with an advantageous further development of the invention, the bus topology components are connected via at least one linear continuation of the machine bus line, which extends from the bus topology components to one of the terminal frames on the machine bus line. This is particularly advantageous from the point of view of production technology because the machine bus line can be executed continuously as has hitherto been the case, so that in this respect all sections of the textile machine can be wired identically. Now it is possible to lead the linear continuation from the terminal frame separately to the middle area of the textile machine. For example, the continuation can be laid on or inside the vacuum duct.

In accordance with an advantageous further development of the invention, the bus topology components are connected to at least one additional bus line, which extends from the repeaters to a middle area of the machine bus line if seen from the longitudinal direction. As a result of this, the physical line paths can be additionally shortened compared to the usage of the linear continuation.

In accordance with an advantageous further development of the invention, the additional bus line is connected to the machine bus line via a machine bus repeater. When a machine bus repeater (which links the machine bus line and the additional bus line) is used, the additional bus line and—as far as no logical separation is provided—the bus topology components, the maintenance device bus lines and maintenance devices are an integral part of the machine bus, making direct—and therefore fast—communication possible.

In accordance with an advantageous further development of the invention, the additional bus line is connected to the machine bus line via a machine bus bridge. Specifically, if a machine bus bridge is used that links the machine bus line and the additional bus line, then a data bus is created, separated logically (and, if applicable, electrically) from the machine bus that comprises the additional bus line, the repeaters, the maintenance device bus lines and the maintenance devices. In this case, another protocol than the one used on the machine bus can be used in the separate data bus created in this way. Likewise, different bandwidths can be provided on the separate data bus and the machine bus. In addition, the additional bridge can assume a filter function, so that only those data that are in each case relevant to the receiver are transferred between the separate data bus and the machine bus. As a result of this, the control and communication system can be optimized, so that more sections can be provided, In particular, the bandwidth can be lowered by the filtering and this makes longer lines possible.

According to a useful further development of the invention, the machine bus repeater and/or the machine bus bridge are developed reactionless. This means that a malfunctioning bus line connected to the machine bus repeater or the machine bus bridge will have no effect on the other connected bus line. In particular, this means that a short circuit or a defective permanent signal in one of the bus lines will not produce any reactions on the other connected bus line. The resulting advantage is that a malfunction in one of the bus lines will not lead to the breakdown of the entire data bus. If, for example, the additional bus line has a short circuit, then the machine bus line is not affected by it.

In accordance with an advantageous further development of the invention, the bus topology components are connected with at least one connection line, which extends from the bus topology components to one of the terminal frames, in which case the connecting bus line is connected to the machine bus line via an additional bridge or an additional repeater. If an additional repeater is used, the connecting line becomes a part of the machine bus, thus ensuring fast data transfer. On the other hand, if a connecting line and an additional bridge that connects the former with the machine bus line are used, they comprise a logically (and, if applicable, electrically) data bus separated from the machine bus and—as far as no logical separation is provided—the bus topology components, the maintenance device bus lines and the maintenance devices. Here, another protocol than the one used in the machine bus can be used in the separate data bus created in this way. Likewise, different bandwidths can be provided in the separate data bus and machine bus. In addition, the additional bridge can assume a filter function so only data relevant for the receiver is transferred between the separate data bus and the machine bus area. As a result of this, the control and communication system can be optimized and more sections can be provided.

In accordance with an advantageous further development of the invention, the bus topology components are directly connected to the machine bus line, the linear continuation of the machine bus line, the additional bus line or the connecting bus line. Now, if the bus topology components are repeaters and connected directly to the machine bus line or linear continuation of the machine bus line, then the maintenance device bus lines and the maintenance devices become a direct part of the machine bus. The same applies if the additional bus line or the connecting bus line is connected to the machine bus line via a repeater. This creates, on the one hand, a direct and therefore fast communication between the maintenance devices and, on the other hand, between the central control device, the drive control device, and the sector control devices, something that is particularly advantageous when malfunctions are rectified in one of the workstations.

In accordance with an advantageous further development of the invention, the bus topology components are connected to at least one maintenance line, which is connected via at least one maintenance bridge to an additional bus line of the control and communication system, especially to the machine bus line, the linear continuation of the machine bus line, the additional bus line or the connecting bus line. As a result of this, a logical autonomous maintenance bus is created that comprises—when the bus topology components are repeaters—the maintenance devices, the maintenance device bus lines, the repeaters, the maintenance bus line and the maintenance bus bridge. If, on the other hand, the bus topology components are bridges, then the maintenance bus includes the bridges, the maintenance bus line and the maintenance bus bridge. In the maintenance bus created in this way, another protocol than the one used in the other data buses of the textile machine can be used. Likewise, different bandwidths can be provided on the maintenance bus and the other data buses of the textile machine. Additionally, the maintenance bus bridge can assume a filter function, so only those data between the maintenance bus and the other data buses of the textile machine are transferred that are in each case relevant for the receiver. As a result of this, the control and communication system can be optimized so that more sections can be provided.

In accordance with an advantageous further development of the invention, the maintenance bus bridge can be connected to the maintenance bus line via a supplementary repeater. This allows the maintenance bus bridge to be connected to the maintenance bus line via a longer stub.

In accordance with an advantageous further development of the invention, the supplementary repeaters and/or the maintenance bus bridge are developed reactionless. This especially means that a short circuit or defective permanent signal occurring on the side of the additional bus line of the control and communication systems will have no effect on the maintenance bus line. The advantage is that a malfunction on the machine bus side will not lead to the breakdown of the entire maintenance bus, so that the maintenance devices can keep communicating through the maintenance bus line.

In accordance with an advantageous further development of the invention, all bus topology components are arranged very closely beside one another. As a result of this, the entire effective line length for the transfer behavior between two maintenance devices can be shortened even more.

In accordance with an advantageous further development of the invention, all bus topology components are arranged on a common board to reduce the effective line length even more and, on the other hand, to create an electronic assembly that can be mounted as a prefabricated whole during final assembly. This greatly simplifies the final assembly of the textile machine.

In accordance with an advantageous further development of the invention, the bus topology components are arranged in the middle of the textile machine in the longitudinal direction. This concept leads to particularly short line lengths that have the advantages described above.

In accordance with an advantageous further development of the invention, the maintenance bus bridge is arranged in the immediate proximity of the bus topology components. This allows the entire line length between two maintenance devices effective for the transfer behavior to be reduced as well.

In accordance with an advantageous further development of the invention, the maintenance bus bridge is arranged on the common board. One the one hand, this can reduce the effective line length even more and on the other hand, this allows an electronic assembly to be created that can be mounted as a prefabricated whole during final assembly to greatly simplify the final assembly of the textile machine.

In accordance with an advantageous further development of the invention, the supplementary repeaters are arranged in the immediate proximity of the bus topology components. As a result of this, the entire effective line length for the transfer behavior between one of the maintenance devices and the other control devices of the textile machine can likewise be shortened.

In accordance with an advantageous further development of the invention, the supplementary repeaters are arranged on the common board. On the one hand, this shortens the effective line lengths even more and, on the other hand, an electronic assembly can be created in this way that can be mounted as a prefabricated whole during final assembly, thus greatly simplifying the final assembly of the textile machine.

According to a useful further development of the invention, the bus topology components have been divided into groups, in which case all bus topology components are arranged in immediate proximity to one another. This solution is especially advantageous when more maintenance devices (e.g. eight or more) are provided. In this case, it can be foreseen for the individual maintenance devices to be movable merely along a portion of one of the workstations. Here, the effective line paths within the group are minimized. Generally, no communication is necessary among the groups. In this way, the number of sections can be further increased with an unchanging maximum effective line length.

In accordance with an advantageous further development of the invention, the bus topology components are arranged in one of the groups in the longitudinal direction of the textile machine, in the middle of a working area allocated to the group of the maintenance devices attached to the group. A group's working area is understood to be the area of those workstations for whose maintenance the group's maintenance devices are responsible. In this way, the effective line lengths within the groups can be additionally shortened.

In accordance with an advantageous further development of the invention, all bus topology components are arranged in one of the groups on a common board. On the one hand, this is one way to reduce the effective line lengths and, on the other hand, an electronic assembly can be created and mounted as a prefabricated whole during the final assembly, something that greatly simplifies the final assembly of the textile machine.

In accordance with an advantageous further development of the invention, a maintenance bus line and a maintenance bus bridge are provided for every one of the groups, arranged in immediate proximity to the group's bus topology components. In this way, several maintenance buses are created, and as a result of this the control and communication system can be further optimized, especially for very long machines. In particular, the effective line lengths within the groups can be further reduced.

In accordance with an advantageous further development of the invention, every one of the maintenance bus bridges is arranged on the corresponding board of the group. On the one hand, this is one way to shorten even more the effective line lengths and, on the other hand, this is also a way to create an electronic assembly that can be prefabricated and mounted as a whole in the final assembly, thus greatly simplifying the final assembly of the textile machine.

In accordance with an advantageous further development of the invention, an additional repeater, arranged in immediate proximity to the group's bus topology components, is provided for every one of the groups. This makes it possible for the corresponding maintenance bus bridge of the group to be connected to the group's maintenance bus line via a longer stub.

In accordance with an advantageous further development of the invention, every one of the additional repeaters is arranged on the respective common board of the group. On the one hand, this is a way to reduce even more the effective line lengths and, on the other hand, to create an electronic assembly for mounting as a prefabricated whole in the final assembly, something that greatly simplifies the final assembly of the textile machine.

The advantageous designs and further designs of the invention described above and/or repeated in the claims can be applied individually or also in any combination with one another—except in those cases where there are clear dependencies or incompatible alternatives.

BRIEF DESCRIPTION OF THE DRAWINGS

The invention will be described in more detail below with the help of drawings, which show.

DETAILED DESCRIPTION

Figure 1:
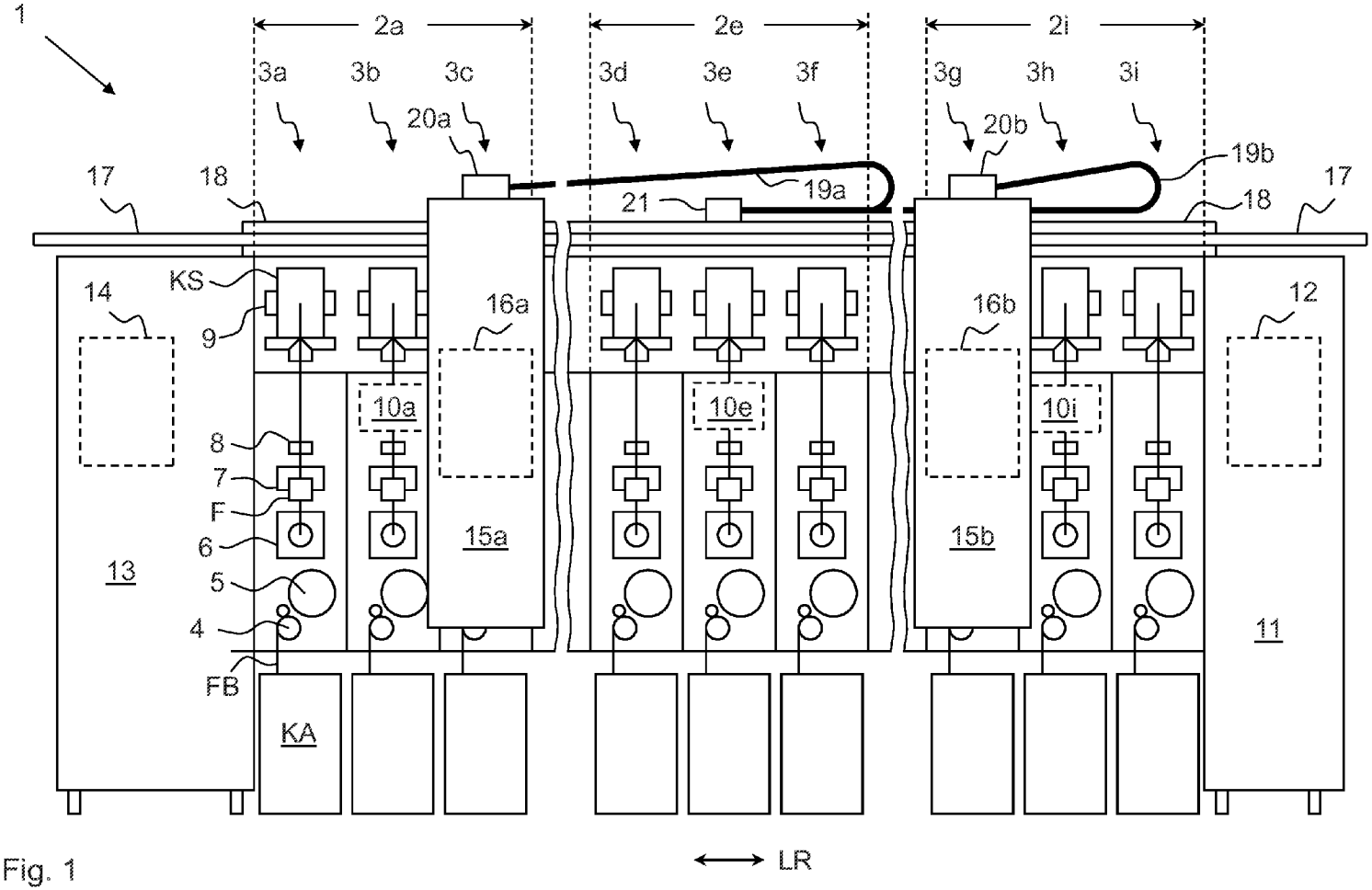
FIG. 1 is a schematic exemplary representation of a longitudinal side of an open-end spinning machine according to the invention with movable maintenance devices.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

In the following figures, only those components of a textile machine will be explained and identified with reference characters that are necessary for understanding the invention. It goes without saying that the textile machine according to the invention can comprise additional parts and assemblies.

FIG. 1 shows a part of the longitudinal side of a rotor spinning machine that serves as example for a textile machine 1 according to the invention. In the figure, the longitudinal direction LR of the textile machine 1 has been symbolized by a double arrow. Three full sections 2*a*, 2*e* and 2*i*, which comprise in each case exemplarily six workstations 3, namely six spinning units 3, are shown. Every one of the sections 2*a*, 2*e* and 2*i*, however, could clearly also have more spinning units 3, for example 16. Owing to the chosen perspective, only three of the six spinning units 3—namely the spinning units 3*a*, 3*b* and 3*c* of section 2*a*, the spinning units 3*d*, 3*e* and 3*f* of section 2*e*, and the spinning units 3*g*, 3*h* and 3*i* of section 2*i*—are visible. The three additional spinning units 3 of sections 2 are arranged on the other longitudinal side of the textile machine (not visible).

Several additional sections 2 are provided between sections 2*a* and 2*e* as well as between sections 2*e* and 2*i*, not shown owing to reasons of space. The number of sections 2 of a rotor spinning machine 1 can vary. Usually, there are 20 sections, for example.

All spinning units 3*a* to 3*i* shown have an identical design. For reasons of clarity, only the essential components of spinning unit 3*a* have been identified with reference characters.

A feeding attachment 4 serves for withdrawing a sliver FB from the can KA made available by the spinning unit 3*a* and the feeding of the sliver FB to an opening device 5. By means of the opening device 5, the fibers being held together in the sliver FB are opened, so that by using means not shown, individual fibers can be fed to the spinning device 6. With the help of the spinning device 6, these individual fibers are spun to a thread F. The term "thread" means the same as the term "yarn".

The spun thread F is drawn off from the spinning device 6 with a pulling-off device 7. Downstream from the pulling-off device 7, a thread monitor 8 has been arranged. The thread monitor 8 has been designed for recognizing thread breaks and to automatically implement suitable measures to rectify the malfunction in case a thread breaks. A winding device 9 finally has the purpose of winding up the spun thread F in a way to create a cross-wound bobbin KS.

Furthermore, for controlling the functional units of the spinning unit 3*a*, a workstation control device (not shown) has been provided that, as the other workstation control devices of spinning units 3*a*, 3*b* and 3*c* of section 2*a*, are connected for exchanging data with a section control device 10*a*. The workstation control devices of section 2*e* are analogously connected to section control device 10*e* the ones of section 2*i* are connected to section control device 10*i*, etc.

On one end of the textile machine 1, a first terminal frame 11 has been schematically drawn that contains a plurality of central devices of the textile machine 1 in a known way. For reasons of clarity, only one machine control device 12 for controlling and monitoring the production of the textile machine 1 has been shown. A control unit (not shown in detail) has been allocated to the machine control device 12. For this reason, the first terminal frame is also known as the operating frame.

On another end of the textile machine 1, a second terminal frame 13 has been schematically drawn that contains a plurality of central drives of the textile machine 1 in a known way. For reasons of clarity, only one drive control device 14 for controlling and monitoring the central drives of the textile machine 1 is shown. The second terminal frame is also known as the driving frame.

Also provided as examples are four maintenance devices 15 movable in longitudinal direction LR from which only the maintenance devices 15*a* and 15*b* are shown because the other maintenance devices 15*c* and 15*d* are located on the other longitudinal side of the textile machine 1. However, even more maintenance devices 15 can be provided. These maintenance devices 15 serve, among other things, for the automatic execution of a piecing process in one of the spinning units 3. The movable maintenance devices 15*a-d* include in each case one control device 16*a-d*, which, as usual, can have an operating unit (not shown).

To make it possible that the maintenance devices 15*a-d* can be moved in longitudinal direction LR from spinning unit 3 to spinning unit 3, they are mounted on a running rail 17 with rollers, for example, from which at least one can be driven.

Furthermore, a vacuum duct 18 is provided on one of the upper sides of the textile machine 1 in the longitudinal direction LR for supplying the maintenance devices 15*a-d* with a vacuum. To achieve this, a connection can be provided on every one of the spinning units 3 for allowing the maintenance units 15 to have an automatic link to the vacuum duct 18.

To make it possible that the maintenance device control devices 16*a-d* can be connected to the machine-proof part of the control and communication system of the textile machine 1, the maintenance device bus lines 19*a-d* designed as trailing cables are provided, from which only the maintenance device bus lines 19*a-b* are visible. Here, the maintenance device bus line 19*a* extends from the maintenance device control device 16*a*, passes through a maintenance device-proof connection device 20*a*, and reaches a machine-proof connection device 21. The maintenance device bus line 19*b* extends analogously from the maintenance device control device 16*b* through a maintenance device-proof connection device 20*b* until it reaches a machine-proof connection device 21, etc.

The maintenance device bus lines 19*a-d* are advantageously designed as trailing cables 19*a-d*. Trailing cables 19*a-d* are long lived because the bending radius can be maintained by the trailing chain via a permissible minimum radius. In addition, they need no active drive of their own, as they can be arranged so they can be dragged by the drive of the movable maintenance devices 15*a-d*. In all of this, it is especially advantageous for the maintenance device bus lines 19*a-d* to be laid with more lines (such as with energy supply lines, for example) in a guiding device. In principle, the maintenance device bus lines 19*a-d* can also be designed as self-spooling cables, however.

Figure 2:
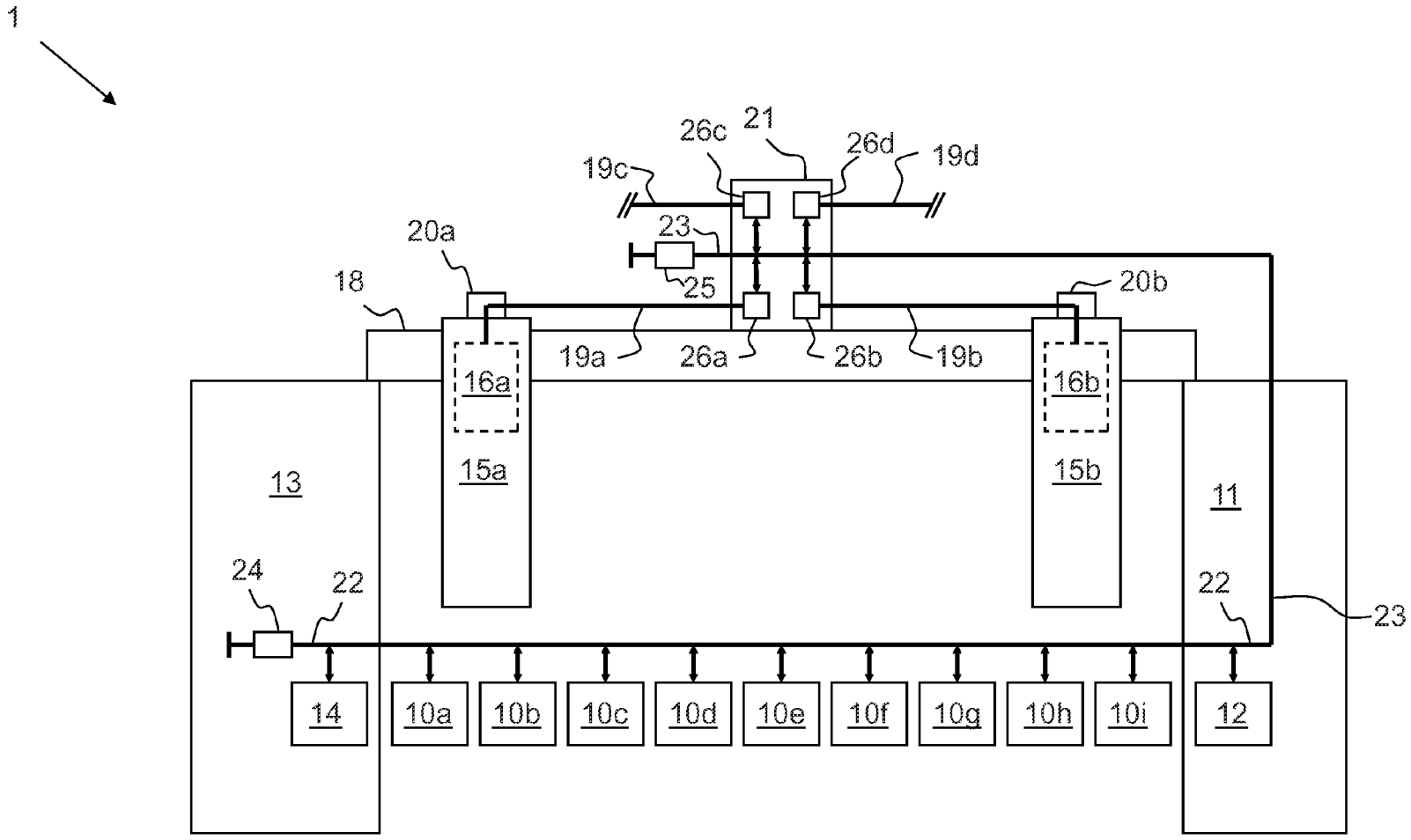
FIG. 2 is a schematic representation of a first embodiment of a control and communication system of a textile machine according to the invention.

FIG. 2 shows a schematic representation of a first embodiment of a control and communication system of the textile machine 1 according to the invention. It has a machine bus line 22 that extends along the textile machine 1 from the first terminal frame 11 to the second terminal frame 13. The section control devices 10*a* to 10*i*, the machine control device 12 and the drive control device 14 are connected as nodes by means of so-called IDC technology or a plug technique without having to physically interrupt the machine bus line 22 as a result of this. Such IDC or plug connections are shown here with short double arrows.

The machine bus line 22 can be, in particular, a linear, continuous physical line that is laid in a machine-long cable duct, for example. The machine bus line 22 can especially consist of section-long parts that are attached with screw connections, plug connections or the like when the textile machine 1 is assembled.

In a first embodiment, the machine bus line 22 has a linear continuation 23 that extends from a first terminal frame 11 to an area of the machine-proof connection device 21. The resulting linear bus line 22, 23 is terminated in the area of the second terminal frame 13 with a first terminal resistance 24 and in the area of the machine-proof connection device 21 with a second terminal resistance 25.

Each one of the maintenance device bus lines 19*a-d* is connected to the machine bus line 22 via a repeater 26*a-d* and via the continuation 23 and terminated on both ends through terminal resistances (not shown).

According to the invention, the bus topology components 26*a-d*, designed as repeaters 26*a-d*, are arranged, when seen in longitudinal direction LR of the textile machine 1, in a middle area of the textile machine 1. By arranging the repeaters 26*a-d* in precisely the middle area, the maintenance device bus lines 19*a-d*, all other things being equal, can now be significantly shortened compared to solutions in which the repeaters 26*a-d* are arranged in one of the terminal frames 11, 13, so that the entire line length effective for the transfer behavior between two of the maintenance devices 15*a-d* can be significantly shortened. In this way, it is possible to increase the entire length of the textile machine 1 (i.e. the number of sections 2 or workstations 3).

Since the repeaters 26*a-d* are at least indirectly connected to the machine bus line 22, a direct and therefore fast communication between the maintenance devices 15*a-d*, on the one hand, and of the central control device 12, the drive control device 14 and the section control devices 10*a-i*, on the other hand, is now possible. This is especially advantageous when malfunctions are rectified in one of the workstations 3.

Since the repeaters 26*a-d* are connected to the machine bus line through the linear continuation 23 of the machine bus line 22, this results especially in production technology advantages because the machine bus line 22 can inherently be designed continuously, as has hitherto been customary, so that in this respect all sections 2 of the textile machine 1 are wired in the same way. The linear continuation 23 can now be led separately from the terminal frame 11 to the middle area of the textile machine 1. For example, the continuation 23 can be laid on or inside the vacuum duct 18.

The repeaters 26*a-d* are advantageously arranged in an area of a machine-proof connection device 21 of the maintenance device bus line 19*a-d* respectively allocated to it. This method makes it possible to minimize the machine-proof section of the maintenance device bus lines 19*a-d*. As a result of this, the entire line length effective for the transfer behavior between two of the maintenance devices 15*a-d* can be minimized and the entire length of the textile machine 1 (i.e. the number of sections 2 or workstations 3) maximized.

The repeaters 26*a-d* are conveniently arranged on an upper side of the textile machine 1. Usually, the movable section of the maintenance device bus lines 19*a-d* runs along the upper side of a textile machine 1. By arranging the repeaters 26*a-d* also on the upper side of the textile machine 1, it is possible to shorten even more the entire line length effective for the transfer behavior between two of the maintenance devices 15*a-d*.

The repeaters 26*a-d* are advantageously arranged in the area of the vacuum duct 18 for supplying the maintenance devices 15*a-d* with a vacuum. More typically, machine-proof connection devices 21 of the maintenance device bus lines 19*a-d* are arranged on one such vacuum duct 18, so that the arrangement of the repeaters 26*a-d* in an area of a vacuum duct 18 contributes to the further shortening of the effective line lengths. In addition, the continuation 23 can run along the vacuum duct 18, especially inside the vacuum duct 18, from which it can be easily and protectively laid.

The repeaters 26*a-d* are advantageously developed to be reactionless. The resulting advantage is that a malfunction on one of the maintenance device bus lines 19*a-d* does not lead to the breakdown of the entire system. If, for example, there is a short circuit in one of the maintenance device bus lines 19*a-d*, it will not affect the continuation 23 of the machine bus line 22, so that the other maintenance devices 15*a-d* can keep communicating through the continuation 23.

It is convenient to attach the repeaters 26*a-d* directly to the linear continuation 23 of the machine bus line 22. If the repeaters 26*a-d* are now directly attached to the machine bus line, which could alternatively be possible, or to the linear continuation 23 of the machine bus line 22, then the maintenance device bus lines 19*a-d* and the maintenance devices 15*a-d* are a direct part of the machine buses. As a result of this, direct—and therefore fast—communication between the maintenance devices 15*a-d*, on the one hand, and the central control device 12, the drive control device 14 and the section control devices 10*a-i*, on the other hand, is possible and this is especially advantageous when malfunctions are rectified in one of the workstations.

It is advantageous if all repeaters 26*a-d* are arranged in immediate proximity to one another. This arrangement makes it possible to shorten even more the entire effective line length for the transfer behavior between two maintenance devices 15*a-d*.

It is advantageous if all repeaters 26*a-d* are arranged on a common board (not shown). On the one hand, this reduces the effective line length further and, on the other hand, an electronic assembly can be created in this way that can be mounted as a prefabricated whole during final assembly, something that greatly simplifies the final assembly of the textile machine 1.

It is convenient if the repeaters 26*a-d* are arranged in the middle of the textile machine 1, in longitudinal direction LR of it. This concept leads to especially short line lengths with the advantages described above.

Figure 3:
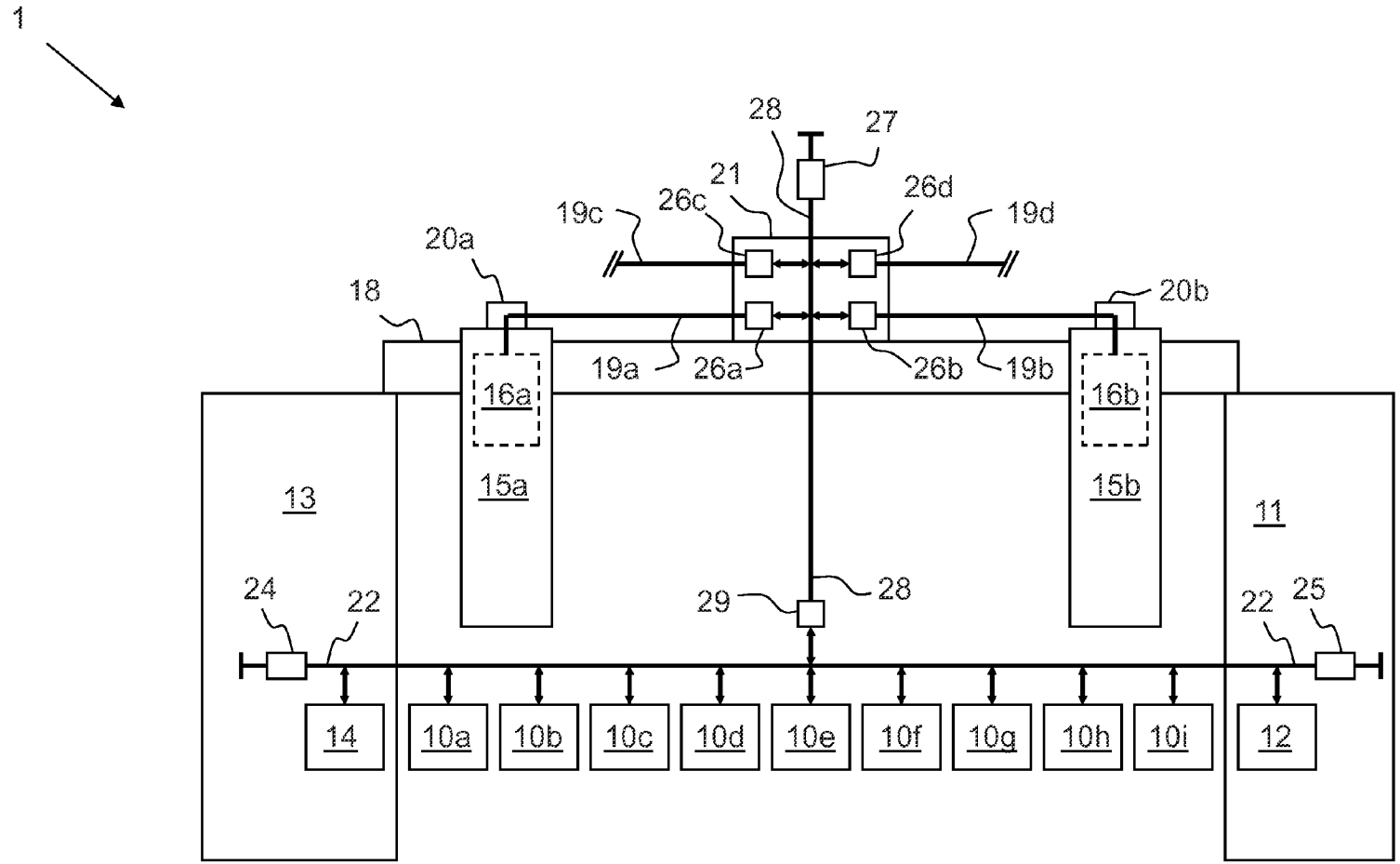
FIG. 3 is a schematic representation of a second embodiment of a control and communication system of a textile machine according to the invention.

FIG. 3 shows a schematic representation of a second embodiment of a control and communication system of a textile machine 1 according to the invention. However, in contrast to the first embodiment, only the differences are explained.

Here, the repeaters 26*a-d* are connected to at least one additional bus line 28 (terminated by means of a third terminal resistance 27), which extends from the repeaters 26*a-d* to a middle area of the machine bus line 22 when seen in longitudinal direction LR. In this case, no continuation 23 is needed and the machine bus line itself is now terminated with the second terminal resistance 25. This allows the physical line lengths to be shortened even more compared to the usage of the linear continuation 23.

It is advantageous for the additional bus line 28 to be connected to the machine bus line 22 via a machine bus repeater 29. If a machine bus repeater 29 that links the machine bus line 22 and the additional bus line 28 is used, then the additional bus line 28 and—as far as no logical separation is foreseen here—the repeaters 26*a-d*, the maintenance device bus lines 19*a-d* and the maintenance devices 15*a-d* are an integral part of the machine bus, which makes direct—and therefore fast—communication possible.

In an embodiment not shown, the additional bus line is connected via a machine bus bridge to the machine bus line, which can replace the machine bus repeater. Specifically, if a machine bus bridge is used for connecting the machine bus line 22 and the additional bus line 28, a data bus separated logically (and if applicable, electrically) from the machine bus that includes the additional bus line 28, the repeaters 26*a-d*, the maintenance device bus lines 19*a-d* and the maintenance devices 15*a-d* is created. In this case, another protocol can be employed in the separated data bus created than in the machine bus. Likewise, different bandwidths can be provided in the separated data bus and in the machine bus. Moreover, the additional bridge can assume a filter function so that only the data relevant to the receiver is transferred between the separated data bus and the machine bus. As a result of this, the control and communication system can be optimized so more sections can be provided.

It is advantageous for the machine bus repeater 29 and/or the machine bus bridge to have a reactionless design. This especially means that a short circuit or defective signal on one of the bus lines 22, 28 will have no reactions on the other connected bus line 22, 28. This has the advantage that a malfunction on one of the bus lines 22, 28 will not lead to a breakdown of the entire system. If, for example, there is a short circuit on the additional bus line 28, then the machine bus line 22 will not be affected by it.

The repeaters 26*a-d* are advantageously connected directly to the additional bus line 28. As a result of this, the maintenance device bus lines 19*a-d* and the maintenance devices 15*a-d* become direct parts of the machine bus as long as the additional bus line is connected to the machine bus line 22 via the machine bus repeater 29. This makes it possible to have a direct—and therefore fast—communication between the maintenance devices 15*a-d*, on the one hand, and the central control device 12, the drive control device 14 and the section control devices 10*a-d*, on the other hand, something that is especially advantageous when malfunctions are rectified in one of the workstations 3.

Figure 4:
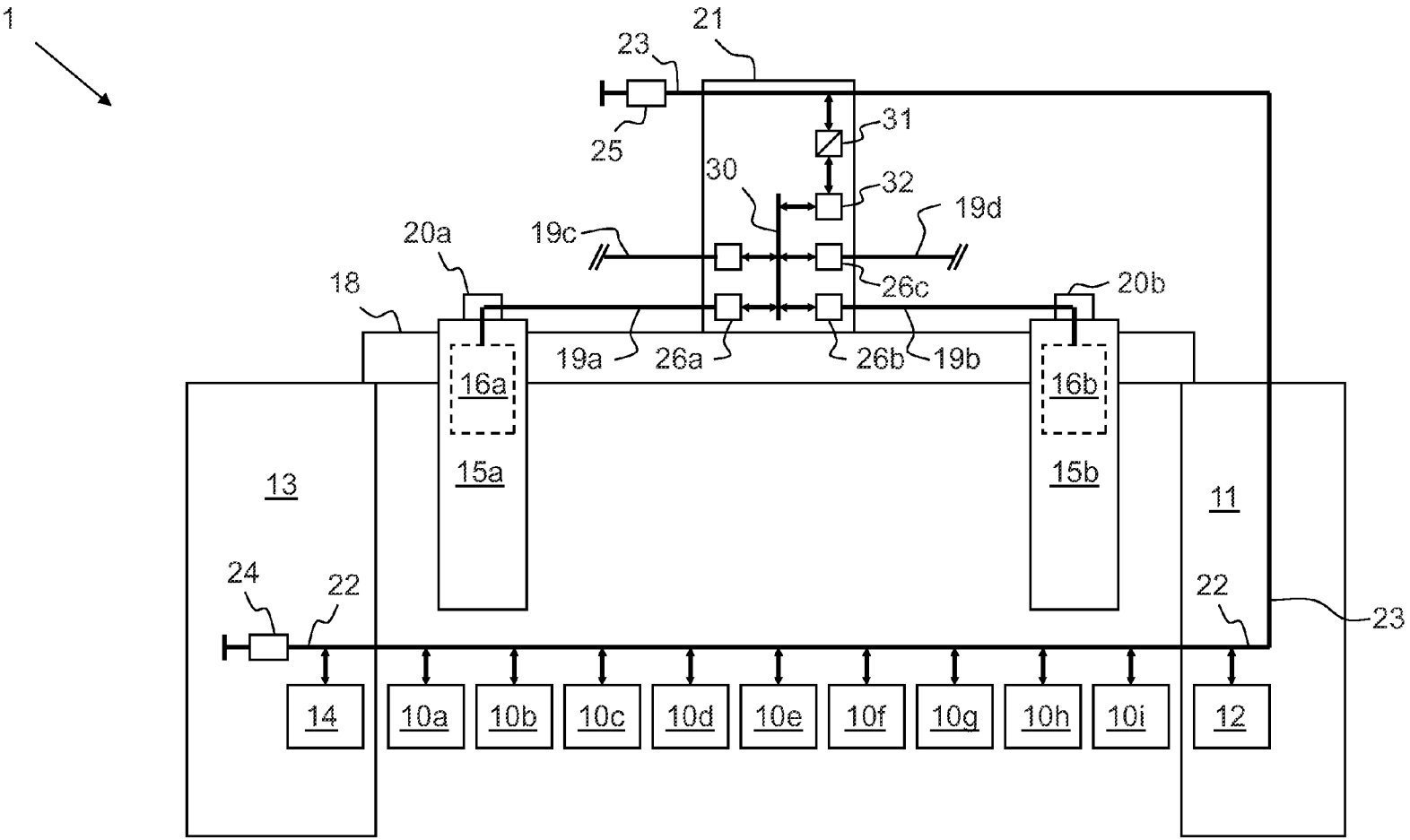
FIG. 4 is a schematic representation of a third embodiment of a control and communication system of a textile machine according to the invention.

FIG. 4 shows a schematic representation of a third embodiment of a control and communication system of a textile machine 1 according to the invention. However, only the differences to the embodiment shown in FIG. 2 are explained below.

In the third embodiment, the repeaters 26*a-d* are connected to at least one maintenance bus line 30 that is connected to the linear continuation 23 of the machine bus line 22 of the control and communication system through at least one maintenance bus bridge 31. The maintenance bus bridge 31, however, could also be connected to another bus line, especially to the machine bus line 22 or the additional bus line 28.

As a result of this, a logical autonomous maintenance bus is created that comprises the maintenance devices 15*a-d*, the maintenance device bus lines 19*a-d*, the repeaters 26*a-d* and the maintenance bus line 30. In this case, another protocol can be employed in the maintenance bus created in this way than in the other data buses of the textile machine. Likewise, different bandwidths can be provided on the maintenance bus and on the other data buses of the textile machine. In addition, the maintenance bus bridge 31 can assume a filter function, so that only data is transferred between the maintenance bus and the other data buses of the textile machine 1 that is in each case relevant for the receiver. This allows the control and communication system to be optimized, so that more sections 2 can be provided.

It is convenient if the maintenance bus bridge 31 is connected to the maintenance bus line 30 via a supplementary repeater 32, thus allowing the maintenance bus bridge 31 to be connected to the maintenance bus line 30 via a longer stub.

Advantageously, the supplementary repeater 32 and/or the maintenance bus bridge 31 are reactionless. This especially means that a short circuit or defective signal on the side of the machine bus will have no reactions on the maintenance bus line 30. This has the advantage that a malfunction on the side of the machine bus will not lead to the breakdown of the entire maintenance bus, so that the maintenance devices 15*a-d* can keep communicating through the maintenance bus line 33.

The maintenance bus bridge 31 is advantageously arranged in the immediate proximity to the repeaters 26*a-d*. As a result of this, the entire line length effective for the transfer behavior between two maintenance devices 15*a-d* can also be shortened.

It is an advantage if the maintenance bus bridge 31 is arranged on the common board. On the one hand, this allows the effective line length to be reduced even more and, on the other hand, an electronic assembly can be created in this way and mounted as a prefabricated whole during the final assembly, something that greatly simplifies the final assembly of the textile machine 1.

Preferably, the supplementary repeater 32 is arranged in immediate proximity to the repeaters 26*a-d*. As a result of this, the entire effective line length for the transfer behavior between two maintenance devices 15*a-d* can likewise be shortened.

Advantageously, the supplementary repeater 32 is arranged on the common board. On the one hand, this allows the effective line lengths to be reduced even more, and on the other hand, an electronic assembly can be created in this way and mounted as a prefabricated whole during the final assembly, something that greatly simplifies the final assembly of the textile machine 1.

Figure 5:
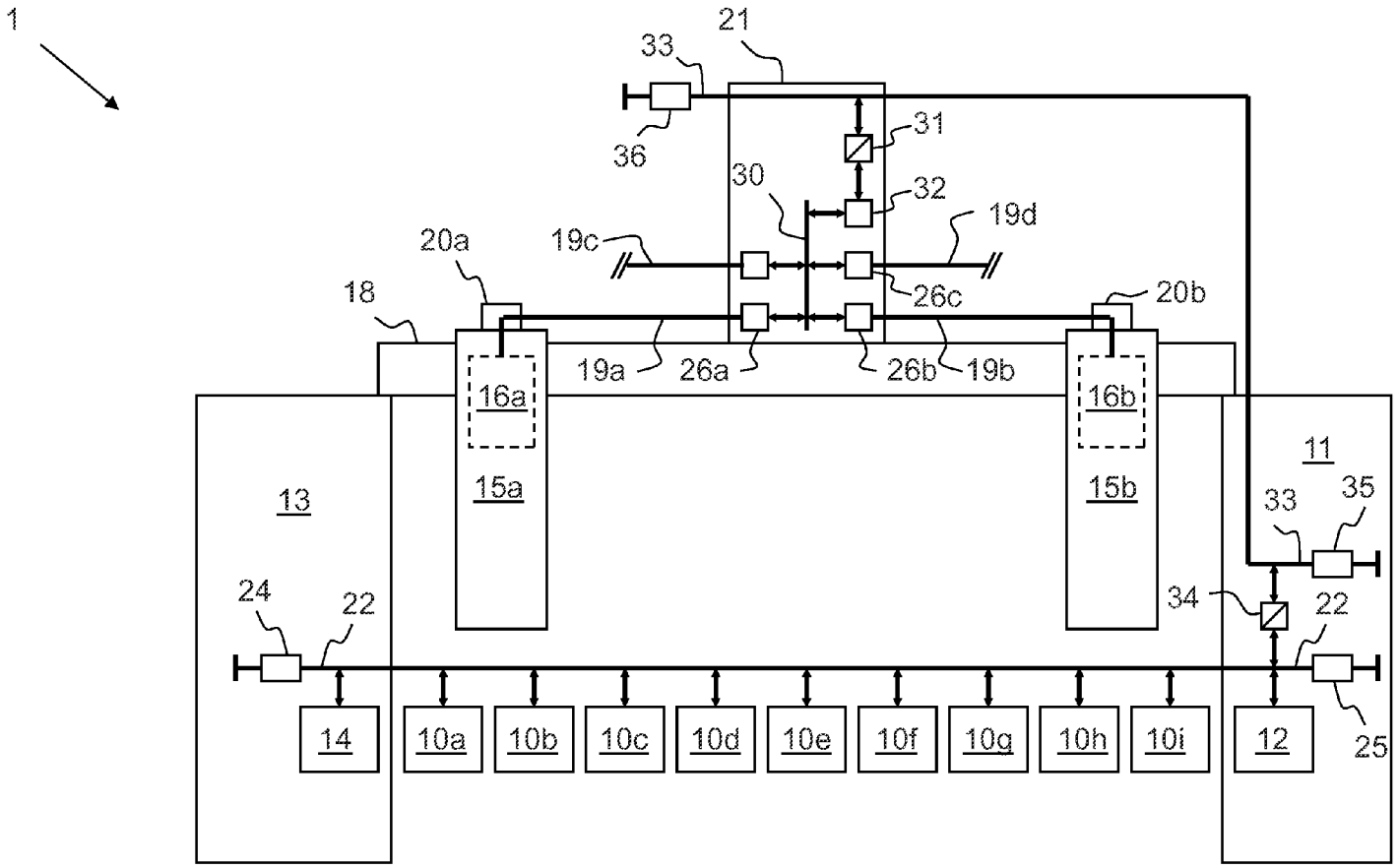
FIG. 5 is a schematic representation of a fourth embodiment of a control and communication system of a textile machine according to the invention.

FIG. 5 shows a schematic representation of a fourth embodiment of a control and communication system of a textile machine 1 according to the invention. However, only the differences to the third embodiment shown in FIG. 4 are explained below.

Here, the repeaters 26*a-d* are connected through the maintenance bus bridge 31 to at least one connecting bus line 33, which extends from the repeaters 26*a-d* to one of the terminal frames 11, in which case the connecting bus line 33 is connected to the machine bus line 22 or to an additional repeater (not shown) via a supplementary bridge 34. The linear continuation 23 is not needed in this case. Alternatively, the repeaters 26*a-d* can be connected directly to the connecting bus line 33. If an additional repeater is employed, the connecting bus line 33 becomes a part of the machine bus and fast data transfer is ensured. On the other hand, if a connection line 33 and an additional bridge 34 connecting the connecting bus line 33 and the machine bus line 22 are employed, a data bus separated logically—and, if applicable, electrically—from the machine bus is created that comprises the connecting bus line 33 and, as far as no logical separation (i.e. especially no maintenance bridge 31) is provided, the repeaters 26*a-d*, the maintenance device bus lines 19*a-d* and the maintenance devices 15*a-d*. In this case, another protocol can be employed in the separate data bus created in this way than in the machine bus. Likewise, different bandwidths can be provided on the separate data bus and the machine bus. In addition, the additional bridge 34 can assume a filter function, so that only data is transferred between the separate data bus and the machine bus that is in each case relevant to the receiver. As a result of this, the control and communication system can be optimized so more sections can be provided.

To prevent reflections, the connecting bus line is terminated through the ends of a fourth terminal resistance 35 and a fifth terminal resistance 36.

Figure 6:
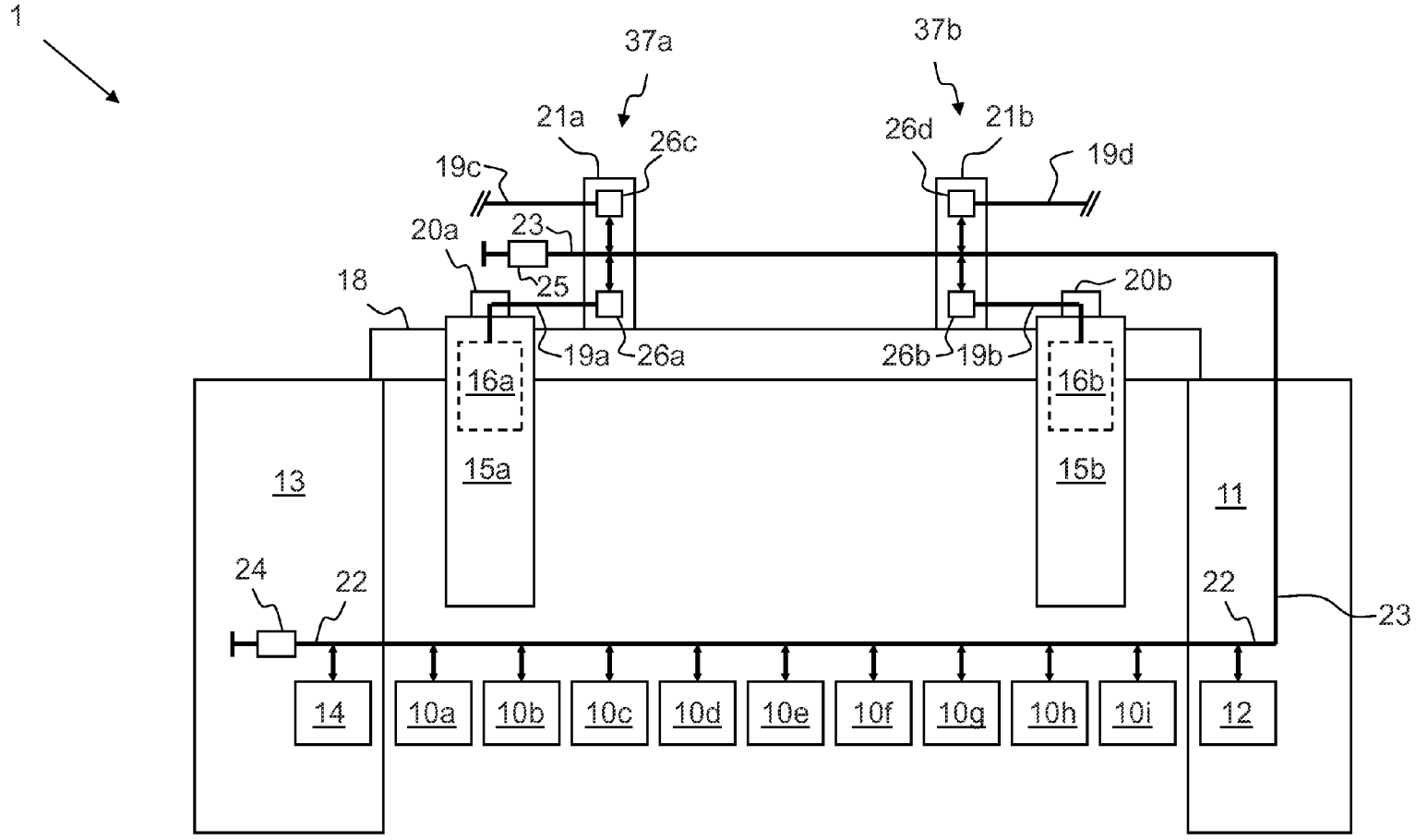
FIG. 6 is a schematic representation of a fifth embodiment of a control and communication system of a textile machine according to the invention.

FIG. 6 shows a schematic representation of a fifth embodiment of a control and communication system of a textile machine 1 according to the invention, but only the differences to the first embodiment shown in FIG. 2 are explained below.

In the fifth embodiment, the repeaters 26*a-d* are subdivided into groups 37*a-b*, in which case group 37*a* includes repeaters 26*a* and 26*c* as well as group 37*b* that includes repeaters 26*b* and 26*d*. Here, all repeaters 26*a* and 26*c* or 26*b* and 26*d* of groups 37*a* or 37*b*, respectively, have been arranged in immediate proximity to one another. This solution is especially advantageous when more maintenance devices 15*a-d* (e.g. eight or more) are provided. In this case, it can be provided that the individual maintenance devices are movable merely along a portion of the workstations 3. Here, the effective line lengths have been minimized within the groups 37*a*, 37*b*. Generally, between the groups 37*a*, 37*b* no communication is necessary between the maintenance devices 15*a* and 15*c* or 15*b* and 15*d*. In this way, the number of sections 2 can be increased even more with the same maximum effective line length.

Advantageously, repeaters 26*a* and 26*c* or 26*b* and 26*d* are arranged in a group 37*a* or 37*b* in the longitudinal direction of the textile machine 1 in the middle of a work area of group 37*a* or 37*b* of the maintenance devices 15*a* and 15*c* or 15*b* and 15*c* attached to group 37*a* or 37*b*. A work area of a group 37*a* or 37*b* is understood to be the area of those workstations 3 for whose maintenance the maintenance devices 15*a* and

15*c* or 15*b* and 15*c* of the group 37*a* or 37*b* are responsible. In this way, the effective line lengths can be further reduced within groups 37*a* or 37*b*.

All repeaters 26*a* and 26*c* or 26*b* and 26*d* are conveniently arranged on a common board of one of the groups 37*a* or 37*b*. On the one hand, this allows effective line lengths to be reduced even more and on the other hand, an electronic assembly can be created that can be mounted as a prefabricated whole during final assembly, something that greatly simplifies the final assembly of the textile machine 1.

One maintenance bus bridge 31 and one maintenance bus line 30 are advantageously provided for every one of the groups 37*a-b*, as shown in FIGS. 4 and 5 and described above, and arranged in the immediate proximity of the repeaters 26*a* and 26*c* or 26*b* and 26*d* of group 37*a* or 37*b*. In this way, several maintenance buses are created and this allows the control and communication system to be optimized even more, especially for very long machines 1. Thus, the effective line lengths within groups 37*a* or 37*b*, in particular, can be further reduced.

Every one of the maintenance bus bridges 31 is advantageously arranged on the corresponding common board of group 37*a* or 37*b*. On the one hand, this reduces the effective line lengths even more and on the other hand, it creates an electronic assembly that can be mounted as a prefabricated whole during final assembly, something that greatly simplifies the final assembly of the textile machine 1.

One supplementary repeater 32 (as shown in FIGS. 4 and 5 and described above) is advantageously provided for every one of the groups 37*a-b*, arranged in the immediate proximity to the repeaters 26*a* and 26*c* or 26*b* and 26*d* of group 37*a* or 37*b*. This arrangement makes it for the respective maintenance bus bridge 31 of group 37*a* or 37*b* to be connected to the maintenance bus line 30 of group 37*a* or 37*b* via a longer stub.

It is advantageous if every one of the supplementary repeaters 32 is arranged on the corresponding common board of group 37*a* or 37*b*. This allows, on the one hand, the further reduction of effective line lengths and, on the other hand, the creation of an electronic assembly that can be mounted as a prefabricated whole during final assembly, something that greatly simplifies the final assembly of the textile machine 1.

Figure 7:
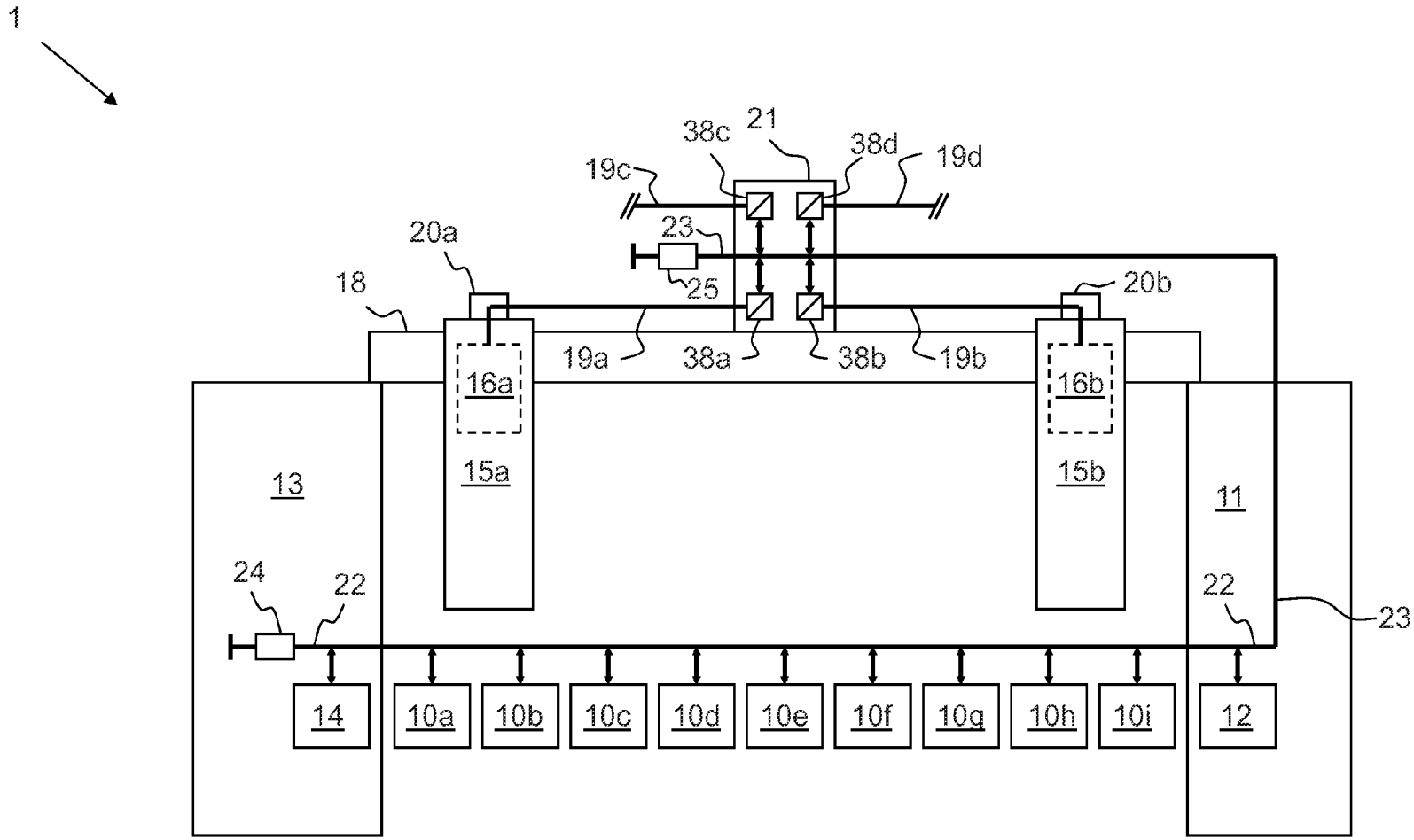
FIG. 7 is a schematic representation of a sixth embodiment of a control and communication system of a textile machine according to the invention.

FIG. 7 shows a schematic representation of a sixth embodiment of a control and communication system of a textile machine 1 according to the invention, but only the differences to the first embodiment shown in FIG. 2 will be explained below.

In FIG. 7, the bus topology components 26*a-d*; 38*a-d* have been designed as bridges 38*a-d*. In this way, a first maintenance device bus is created that comprises the first maintenance device control device 16*a*, the first maintenance device bus line 19*a* and the first bridge 38*a*. Furthermore, a second maintenance device bus (which comprises the second maintenance device control device 16*b*, the second maintenance device bus line 19*b* and the second bridge 38*b*), a third maintenance device bus (which comprises the third maintenance device control device 16*c*, the third maintenance device bus line 19*c* and the third bridge 38*c*), and a fourth maintenance device bus (which comprises the fourth maintenance device control device 16*d*, the fourth maintenance device bus line 19*d* and the fourth bridge 38*d*) are created.

Here, particularly long maintenance device bus lines 19*a-d* are possible because in this case, the length of the maintenance device bus lines 19*a-d* can correspond to the maximum possible length of the corresponding maintenance device buses. Additionally, the bandwidth on the four maintenance device bus lines 19*a-d* can be chosen to be smaller, so that they can be particularly long.

Modifications and variations can be made to the embodiments illustrated or described herein without departing from the scope and spirit of the invention as set forth in the appended claims.

The invention claimed is:

1. A textile machine having a plurality of spinning or winding workstations arranged side-by-side along a longitudinal side of the textile machine between opposite terminal end frames of the textile machine, the textile machine comprising:

a plurality of maintenance devices configured to move in the longitudinal direction alongside the workstations for servicing the workstations;

a control and communication system having a common data bus line, the maintenance devices in communication with the control and communication system;

each of the maintenance devices connected to a bus topology component through a maintenance device bus line, wherein the maintenance device bus lines are a trailing cable or self-spooling line;

at least certain ones of the bus topology components connected to the common bus line and arranged in a stationary connection device located at a middle area of the textile machine in the longitudinal direction between the terminal frames of the textile machine;

the bus topology components physically connecting the maintenance device bus lines to the common bus line.

2. The textile machine as in claim 1, wherein the bus topology components are repeaters or bridges.

3. A textile machine, having a plurality of spinning or winding workstations arranged side-by-side along a longitudinal side of the textile machine between opposite terminal end frames of the textile machine, the textile machine comprising:

a plurality of maintenance devices configured to move in the longitudinal direction alongside the workstations for servicing the workstations;

a control and communication system having a common bus line, the maintenance devices in communication with the control and communication system;

each of the maintenance devices connected to a bus topology component through a maintenance device bus line;

at least certain ones of the bus topology components connected to the common bus line and arranged in a middle area of the textile machine in the longitudinal direction between the terminal frames of the textile machine; and wherein the bus topology components are arranged in a connection device on an upper side of the textile machine in a vacuum duct, wherein the vacuum duct is configured to supply the maintenance devices with vacuum.

4. The textile machine as in claim 1, wherein the maintenance bus lines comprise trailing cables.

5. The textile machine as in claim 1, wherein the bus topology components are electrically reactionless components wherein if one of the bus topology components shorts or otherwise electrically fails, remaining ones of the bus topology components are electrically unaffected.

6. The textile machine as in claim 1, wherein the bus topology components are arranged longitudinally in the direction of the textile machine on a common board at a middle area of the textile machine.

7. The textile machine as in claim 1, wherein the common bus line comprises a machine bus line that extends along the textile machine between the opposite terminal end frames, the bus topology components connected directly or indirectly to the machine bus line.

8. The textile machine as in claim 7, wherein the bus topology components are connected to a linear continuation of the machine bus line that extends from the bus topology components to one of the terminal end frames of the textile machine.

9. The textile machine as in claim 7, wherein the bus topology components are connected to an additional bus line that extends from the bus topology components to a middle area of the machine bus line in the longitudinal direction, the additional bus line connected to the machine bus line through either of an electrically reactionless machine bus repeater or machine bus bridge.

10. The textile machine as in claim 7, wherein the bus topology components are connected to a connecting bus line that extends from the bus topology components to one of the terminal end frames of the textile machine, the connecting bus line connected to the machine bus line at the terminal end frame with a bridge or repeater.

11. The textile machine as in claim 7, wherein the bus topology components are connected to a maintenance bus line, the maintenance bus line connected to the machine bus line or another bus line of the control and communication system through a maintenance bus bridge that is connected to the maintenance bus line through a supplementary repeater.

12. The textile machine as in claim 11, wherein the bus topology components are arranged longitudinally in the direction of the textile machine on a common board at a middle area of the textile machine, the maintenance bus bridge arranged on the common board.

13. The textile machine as in claim 12, wherein the supplementary repeater is arranged on the common board.

14. The textile machine as in claim 1, wherein the bus topology components are divided into groups, with each of the groups assigned to a different longitudinal work area of the textile machine, the bus topology components of each group arranged on a respective common board, wherein the common boards are arranged on the textile machine at a middle of their respective work area.

15. The textile machine as in claim 14, wherein each of the groups has a maintenance bus line and a maintenance bus bridge assigned thereto and arranged on the common board.

16. The textile machine as in claim 15, wherein each of the groups has a supplementary repeater assigned thereto and arranged on the common board.

* * * * *